United States Patent [19]

van Dijk et al.

[11] Patent Number: 4,750,942

[45] Date of Patent: Jun. 14, 1988

[54] RINSE AID

[75] Inventors: Jakob van Dijk; Hendrik S. Kielman, both of Maassluis; Leendert Los, Woerden; Rudolf C. Verheul, Vlaardingen, all of Netherlands

[73] Assignee: Lever Brothers Company, New York, N.Y.

[21] Appl. No.: 68,693

[22] Filed: Jun. 30, 1987

[30] Foreign Application Priority Data

Jul. 8, 1986 [GB] United Kingdom ..... 861615

[51] Int. Cl.[4] ..... B67C 1/04

[52] U.S. Cl. ..... 134/25.2; 134/25.4; 252/142; 252/147; 252/309; 252/313.2; 252/315.6

[58] Field of Search ..... 252/313.2, 315.6, 309, 252/142, 147; 134/25.2, 25.4

[56] References Cited

U.S. PATENT DOCUMENTS

| | | | |
|---|---|---|---|
| 2,801,902 | 8/1957 | Alexander et al. | 23/182 |
| 3,354,088 | 11/1967 | Elmquist | 252/90 |
| 3,736,259 | 5/1973 | Buck et al. | 252/89 |
| 3,755,180 | 8/1973 | Austin | 252/99 |
| 3,919,101 | 11/1975 | Anstett et al. | 252/90 |
| 3,981,826 | 9/1976 | Munro | 252/526 |
| 4,275,118 | 6/1981 | Baney | 428/412 |
| 4,343,717 | 8/1982 | Lok | 252/313 S |

FOREIGN PATENT DOCUMENTS

| | | |
|---|---|---|
| 110472 | 6/1984 | European Pat. Off. . |
| 139330 | 5/1985 | European Pat. Off. . |
| 2427747 | 1/1975 | Fed. Rep. of Germany . |
| 0007840 | 12/1980 | Japan . |
| 0133100 | 7/1985 | Japan . |

OTHER PUBLICATIONS

"Ludox ® Colloidal Silica Product Brochure".
"Condea Product Brochure".
"Degussa Brochure".
"Monsanto Bulletin".

*Primary Examiner*—Paul Lieberman
*Assistant Examiner*—Kathleen Markowski
*Attorney, Agent, or Firm*—Milton L. Honig; James J. Farrell

[57] ABSTRACT

The use of a non-plate-shaped colloid, e.g. a silica in a rinse-aid composition for use after a dishwashing operation reduces the drying time and the formation of spots on the rinsed articles when dry.

6 Claims, No Drawings

RINSE AID

The present invention relates to a rinse aid for use in the rinsing step of machine dishwashing operations.

In the mechanical washing of dishes, the articles to be cleaned generally are first subjected to a main washing step, which is subsequently followed by one or more rinsing steps to remove adhering main-wash detergent ingredients or remaining soil.

It is customary to add in the rinsing step a rinse aid which causes the article to dry more evenly and improves the visual appearance thereof when dry.

Despite the use of such rinse aids, the visual appearance of articles after the mechanical washing process often is still not optimal, owing to spot formation during the drying process.

It has been proposed in European Patent Application No. 0 139 330 to reduce the formation of spots on the rinsed articles by using a rinse aid which includes a limited amount of a layered clay.

It has now been found that a significant reduction of spot formations during the drying process is also achieved by inclusion of colloids such as colloidal silica or alumina in the rinse-aid composition.

It has further been found that the use in the rinse aid of colloids having non-plate-shaped particles such as colloidal silica or alumina gives a surprising reduction in the drying time of the rinsed articles.

Reduction of the drying time is of the utmost relevance to machine dishwashing operations, particularly in industrial, semi-industrial or institutional machine dishwashing applications.

The reduction of the drying time and the fact that, by inclusion of colloids of the above type, the conventional nonionic surfactant component can be deleted, opens the possibility of reducing the temperature in the rinsing cycle and consequently achieving energy savings, without being confronted with an over-foam problem (due to reduction of the temperature to below the cloud point of the nonionic surfactant).

Inclusion of colloidal silica in fully formulated liquid detergent compositions is well known.

In EP No. 0 110 472 the use of silica as a corrosion-inhibiting agent in aqueous liquid detergent compositions is described.

In U.S. Pat. No. 3,354,088 amorphous silica is used as a flow-retarding agent in an aqueous aerosol-type window cleaner.

In U.S. Pat. No. 3,736,259 and U.S. Pat. No. 3,919,101 the use of silica in carpet-cleaning compositions is described.

To our knowledge, the inclusion in rinse-aid products of a non-plate-shaped colloid such as colloidal silica or alumina as an anti-spotting agent or as an agent for reducing drying time has never been described or suggested.

Accordingly, the present invention provides an aqueous rinse-aid composition having improved anti-spotting and drying properties, characterised in that it comprises an effective amount of a non-plate-shaped colloid in an aqueous medium.

In a further aspect, the present invention provides a method of reducing the spot formation and the drying time in machine dishwashing operations, comprising the addition of a non-plate-shaped colloid to the liquor for rinsing the dishes.

For the purposes of the present invention, the term "non-plate-shaped colloid" encompasses all colloids having a particle shaped which is not characterised by a size in one dimension which is significantly smaller than the sizes in the other two dimensions.

In particular, colloids having approximately spherical particles are preferred, suitable examples of which are the colloidal forms of silica, alumina, titania and the like.

The colloid suitable for use in the compositions and method of the present invention preferably has a relatively low average elementary particle size typical for colloidal solution-forming particles, ranging from about 0.001 to about 1 micrometer, or even 5 micrometers. The lower portion of this range, particularly the range of 0.002 to 0.05 micrometers, is preferred for reasons of effectiveness.

The most preferred type of colloid for use in accordance with the present invention is colloidal silica.

A range of suitable silicas is commercially available under the trade name Ludox colloidal silica in various grades (Ludox is a Registered Trade Mark of the Du Pont Company), under the trade name Syton colloidal silica (Syton is a Registered Trade Mark of the Monsanto Company) and in various grades under the trade name Aerosil (Aerosil is a Registered Trade Mark of Degussa). Ludox is a precipitated silica, whilst Aerosil is a flame hydrolysed silica.

The colloid may be added to the rinsing liquor as such, or it may be added in the form of a colloidal dispersion or in the form of a rinse-aid composition in any suitable physical form comprising the colloid and further suitable conventional rinse-aid ingredients.

The level of the colloid in the rinsing liquor should be such that the rinsing liquor contains from about 0.5 to 150 mg of the colloid per liter.

Rinse-aid compositions in accordance with the present invention may include the colloid in an amount of from 0.2 to 25% by weight. An amount of from 0.5 to 10% is preferred, an amount of 1 to 5% by weight being preferred most.

Suitable rinse-aid compositions may optionally comprise an acidic compound, in particular an organic acid, such as eg citric, adipic, glutaric or succinic acid. The acidic compound may be included in an amount of up to 50% by weight, preferably from 5 to 30% by weight.

However, it has surprisingly been found that the reduction in spotting brought about by the addition of, eg citric acid to conventional rinse aid formulations is equalled by the use of the colloid-containing rinse aids of the present invention when citric acid is absent. The ability to omit such organic acids whilst achieving comparable effects provides considerable economic advantages.

Further suitable conventional ingredients for inclusion in the compositions according to the present invention are hydrotropic agents such as butylated hydroxytoluene, alcohols, wetting agents such as nonionic surfactants, perfumes, germicides, anti-corrosion agents and colouring agents.

The addition of short-chain, water-soluble alcohols (eg $C_1$–$C_3$) to the rinse aid according to the present invention is particularly preferred. It has been found that the colloidal sol may form a precipitate in conjunction with some conventional rinse-aids. This may occur, eg on refilling the rinse-aid dispenser with rinse-aid, a residue of the previous, different rinse-aid often remaining. Alcohol may be included in an amount up to 40%, preferably 10–30% by weight, most preferably 20–30% by weight.

The rinse-aid may be used in conjunction with all conventional main-wash products, both enzymatic and non-enzymatic. Such products may be in any known form, eg powders, liquids or tablets.

It will be understood that the rinse-aid may contain two-dimensional aggregated arrays of the non-plate-shaped colloid. Processes for the preparation of such aggregates have been described within U.S. Pat. No. 2,801,902 and European Application No. 87303527.3 (Unilever). Such arrays are usually in the form of compact monolayers. The most preferred colloid demonstrating this behaviour is silica sol.

The invention will be further illustrated by way of examples.

EXAMPLES

In the experiments described in the examples below, a standard set of glassware soiled with a standard evaluation soil was used to evaluate spot and film formation.

The experiments were carried out in the following commercially-available dishwashing machines:

(1) Miele G 560, sold by Miele & Cie, Germany;

(2) Zanussi Z 82, sold by Industrie Zanussi SpA, Italy;

(3) Bosch M 500, sold by Bosch-Siemens Hausgeräte GmbH, Germany.

In the washing programmes, tap water of about 9 degrees German hardness was used and machine dishwashing main-wash products having a composition as indicated below were dosed at a product concentration of 3 g/l. The rinse-aid products, if any, were added to the final rinsing liquor at a dosage of 3 ml per rinse (approximately 10 liters).

MAIN-WASH PRODUCT COMPOSITIONS

| Ingredients | A | B | C | D |
|---|---|---|---|---|
| Sodium tripolyphosphate | 33 | 33 | 33 | 36 |
| Sodium metasilicate | — | 50 | 33 | 17 |
| Sodium disilicate | 9 | — | — | — |
| Sodium carbonate | 9 | — | — | — |
| Amylase | 1.8 | — | 0.5 | 0.6 |
| Protease | 1.8 | — | 1.0 | 0.6 |
| Tetraacetylethylenediamine | 3.6 | — | — | — |
| Sodium perborate.4 aq. | 8 | — | 10 | 9 |
| Calcium salt of ethylene-diaminetetraphosphonic acid | 0.6 | — | — | — |
| Alkoxylated nonionic surfactant | — | 1.0 | 1.5 | — |
| Potassium salt of dichlorocyanuric acid | — | 2.1 | — | — |
| Sodium sulphate/water | | balance | | |

After the main-wash and rinse steps, the glassware, when dry, was visually assessed as to spot and film formation using the following scales:

1=no spots
2=1–5 spots
3=6–10 spots
4=11–20 spots
5=more than 20 spots.

1=no film formation
2=traces of film formation
3=moderate film formation
4=heavy film formation.

EXAMPLE 1

The spot and film formation effects of the addition of a series of rinse-aid products simply consisting of aqueous dispersions of colloidal silica were measured at various concentrations of the colloidal silica.

All experiments were carried out in dishwashing machine type (1), using main-wash product type A, at two temperatures of the final rinse.

The following results were obtained:

| Final rinse temperature | 65° C. | 45° C. | 65° C. | 45° C. |
|---|---|---|---|---|
| Rinse aid | Spot | | Film | |
| No rinse aid | 4.4 | 3.9 | 1.1 | 1.4 |
| 5% Ludox SM (1) | 3.2 | 2.7 | 2.1 | 2.1 |
| 6% Ludox TM (2) | 1.8 | 1.9 | 2.1 | 2.1 |
| 7.5% Ludox SM | 2.1 | 2.4 | 2.0 | 2.1 |
| 10% Ludox SM | 1.7 | 2.0 | 2.2 | 2.0 |
| 10% Ludox AM(3) | 2.4 | 2.4 | 2.0 | 2.0 |
| 16% Ludox SM | 1.4 | — | 2.6 | — |

(1)Ludox SM (®) is a colloidal silica (30% by weight as $SiO_2$; counter-ion is sodium) ex Du Pont, having an average particle size of 7 nm.
(2)Ludox TM (®) is a colloidal silica (50% by weight as $SiO_2$; counter-ion is sodium) ex Du Pont, having an average particle size of 22 nm.
(3)Ludox AM (®) is a colloidal silica (30% by weight as $SiO_2$; counter-ion is sodium) ex Du Pont, having an average particle size of 12 nm.

EXAMPLE 2

In a dishwashing machine of type (2), using a main-wash product type B, the spot- and film-forming behaviour of a rinse-aid composition in accordance with the present invention was measured after 1 and 4 programme cycles at final rinse temperatures of 40° and 60° C. The composition of the rinse aid was as follows:

| Ingredients | % by weight |
|---|---|
| Ludox SM | 7.5 |
| Citric acid | 18.0 |
| Butylhydroxytoluene | 0.1 |
| Colouring agent | 0.003 |
| Water | balance |

The following results were obtained:

| | Final rinse temperature | | | |
|---|---|---|---|---|
| | 60° C. | 40° C. | 60° C. | 40° C. |
| | Spot | | Film | |
| After 1 wash cycle | | | | |
| Without rinse aid | 2.9 | 4.0 | 2.0 | 2.0 |
| With rinse aid | 2.0 | 1.0 | 2.0 | 2.0 |
| After 4 wash cycles | | | | |
| Without rinse aid | 4.0 | 4.0 | 2.0 | 2.0 |
| With rinse aid | 2.0 | 2.0 | 2.0 | 2.0 |

EXAMPLE 3

Using dishwashing machine type (3) and main-wash products C and D, the spot and film formation behaviour of the rinse-aid composition used in Example 2 was assessed at 55° C. final rinse temperature.

The following results were obtained:

| | Main-wash product | | | |
|---|---|---|---|---|
| | C | D | C | D |
| | Spot | | Film | |
| Without rinse aid | 3.9 | 4.8 | 1.5 | 1.4 |

-continued

| | Main-wash product | | | |
|---|---|---|---|---|
| | C | D | C | D |
| | Spot | | Film | |
| With rinse aid | 1.9 | 2.0 | 2.0 | 2.0 |

EXAMPLE 4

The drying times after the final rinse of a standard set of glassware were measured in an industrial Electrolux D48 single-tank washing machine sold by Electrolux-Wascator, Sweden, using the normal washing programme at 60° C., and tap water of 8 degrees German hardness.

A comparison was made between final rinses with three conventional rinse aids and the rinse aid of Example 2.

The compositions of the conventional rinse-aid products were as follows:

| Ingredients | 1 | 2 | 3 |
|---|---|---|---|
| Alkoxylated nonionic surfactants | 10.0 | 50.0 | — |
| Layered clay | — | — | 8.0 |
| Citric acid | 18.0 | — | — |
| Formaline | — | 0.1 | — |
| Sodium xylene sulphonate | 3.0 | — | — |
| Butylhydroxytoluene | 0.1 | — | — |
| Colouring agent | 0.003 | 0.003 | — |
| Water | | balance | |

The rinse aids were added at a concentration of 0.2 g/l.

Experiments were carried out at three temperatures of the final rinse.

Drying times are expressed as a drying time range since they are dependent upon the heat capacity and consequently the thickness of the individual glass aritic-cles.

The following results were obtained:

| | Drying Time in Seconds | | |
|---|---|---|---|
| Final rinse temperature | 60° C. | 70° C. | 80° C. |
| Conventional rinse aid 1 | 61–160 | 55–137 | 43–95 |
| Conventional rinse aid 2 | 57–170 | 53–169 | 43–125 |
| Conventional rinse aid 3 | 59–177 | | |
| Rinse aid according to Example 2 | 43–71 | 45–60 | 31–43 |

EXAMPLE 5

In a set of comparative experiments analogous to Example 4, the foam behaviour at the various rinse aids was measured. The foam behaviour is expressed in cm of foam above the wash bath.

The following results were obtained:

| | cm of Foam Above Wash Bath Final rinse temperature | | | | |
|---|---|---|---|---|---|
| | 30° C. | 40° C. | 50° C. | 60° C. | 70° C. |
| Conventional rinse aid 1 | 5 | 5 | 3 | 1 | 1 |
| Conventional rinse aid 2 | 3 | 3 | 3 | 2 | 1 |
| Conventional rinse aid 3 | 0 | 1 | 1 | 2 | 1 |
| Rinse aid according to Example 2 | 2 | 1 | 1 | 0 | 0 |

EXAMPLE 6

In further comparative experiments, the influence of type of rinse aid on glass appearance was tested. Comparisons were made in machine type (3) after 1 and 4 wash cycles with main-wash product A, the final rinse temperature being 65° C.

The following results were obtained:

| | Number of cycles | | | |
|---|---|---|---|---|
| | 1 | 4 | 1 | 4 |
| | Spot | | Film | |
| Without rinse aid | 4.7 | 4.7 | 1.5 | 1.5 |
| Ludox SM (0% citric acid) | 1.5 | 1.5 | 2.4 | 2.4 |
| Conventional Product 1 | 3.5 | 3.5 | 2.3 | 2.5 |

EXAMPLE 7

An experiment was carried out to determine the stability of a rinse aid according to the present invention in admixture with a conventionally used rinse-aid (Product 1). This experiment demonstrates stability as a new rinse-aid is added to the dispenser before the old rinse-aid has been exhausted. Negligible (<5%) flocculation occurs if 25 wt % iso-propanol is added to a Ludox-based rinse-aid when the dispenser is at least one-third exhausted of conventional rinse-aid.

| Conventional Product: Ludox Rinse Aid | Flocculation |
|---|---|
| 90:10 | 5% |
| 75:25 | approx 30% |
| 66:33 | 5% |
| 50:50 | <5% |
| 25:75 | <5% |
| 10:90 | approx 0% |

EXAMPLE 8

Using dishwashing machine type (1) and main-wash product type B, the spot and film formation behaviour of a Ludox SM rinse-aid with varying amounts of citric acid was assessed at 65° C. final rinse temperature with 26° French hard water. A build-up of 4 wash cycles was assessed.

| | 0% Citric | 6% Citric | 12% Citric | 18% Citric | None |
|---|---|---|---|---|---|
| Tumbler | | | | | |
| Spot | 2.3 | 2.1 | 2.1 | 3.1 | 3.0 |
| Film | 4.0 | 4.0 | 4.0 | 3.5 | 2.7 |
| Cutlery | | | | | |
| Spot | 1.9 | 1.7 | 1.5 | 1.9 | 3.0 |
| Film | 2.1 | 2.1 | 2.0 | 2.2 | 3.0 |

EXAMPLE 7

The spot and film formation effects of Ludox-based rinse-aids with and without citrate were assessed, using dishwashing machine type (1) and main-wash product type C. Final rinse temperature was 40° C. or 60° C. Assessment was made after 1 and 4 wash cycles. Comparison with conventional product 1 was made.

| 40° C. | None 1 | None 4 | +0% Citrate 1 | +0% Citrate 4 | +18% Citrate 1 | +18% Citrate 4 | 1 1 | 1 4 |
|---|---|---|---|---|---|---|---|---|
| Spots Tumbler | 2.1 | 2.7 | 2.0 | 2.0 | 1.7 | 2.3 | 1.1 | 1.5 |
| Film Tumbler | 3.0 | 3.0 | 3.0 | 3.8 | 3.0 | 3.5 | 3.0 | 3.6 |
| Spots Knives | 2.4 | 2.4 | 1.3 | 1.4 | 1.7 | 1.5 | 2.6 | 3.4 |
| Film Knives | 2.4 | 2.7 | 2.3 | 2.5 | 2.4 | 2.5 | 2.7 | 2.9 |

| 60° C. | None 1 | None 4 | +0% Citrate 1 | +0% Citrate 4 | +18% Citrate 1 | +18% Citrate 4 | 1 1 | 1 4 |
|---|---|---|---|---|---|---|---|---|
| Spots Tumbler | 1.9 | 3.4 | 1.5 | 1.5 | 1.9 | 2.0 | 2.0 | 1.6 |
| Film Tumbler | 3.0 | 3.0 | 3.0 | 4.0 | 3.0 | 3.5 | 4.0 | 4.0 |
| Spots Knives | 2.2 | 2.4 | 1.3 | 1.3 | 1.5 | 1.4 | 1.6 | 2.4 |
| Film Knives | 2.6 | 2.9 | 2.8 | 2.6 | 2.6 | 2.3 | 2.8 | 2.8 |

EXAMPLE 10

A number of colloids were tested for their rinse-aid benefit. Main-wash at 60° C. using 2 g/l of main-wash product B was followed by rinse at 65° C. The dosage of colloids was assessed by total surface area.

| Type of Colloid | Surface Area ($M^2$) | Spot | Film |
|---|---|---|---|
| Alumina C | 22.5 | 4.6 | 1.6 |
| | 60 | 2.0 | 2.6 |
| | 75 | 2.0 | 2.3 |
| | 100 | 2.1 | 2.3 |
| Lepandin 20 N | 20 | 4.8 | 1.5 |
| | 60 | 2.0 | 2.2 |
| | 75 | 1.8 | 2.2 |
| | 100 | 1.8 | 2.2 |

-continued

| Type of Colloid | Surface Area ($M^2$) | Spot | Film |
|---|---|---|---|
| $TiO_2$ | 25 | 3.7 | 1.9 |
| | 50 | 4.6 | 3.1 |
| | 75 | 2.8 | 3.7 |
| | 100 | 1.6 | 3.7 |
| Dispersal | 50 | 2.2 | 2.0 |
| | 75 | 2.4 | 2.1 |
| | 100 | 1.8 | 2.0 |
| Ludox SM | 27 | 1.6 | 2.2 |
| | 81 | 1.5 | 2.1 |
| | 100 | 1.5 | 2.0 |
| Aerosil 380 | 30 | 2.4 | 2.1 |
| | 90 | 1.2 | 2.8 |
| | 120 | 1.5 | 2.7 |
| Blank | — | 4.0 | 1.4 |

Lepandin and Aerosil are products of Degussa. The former is an alumina, the latter is silica silicas. Dispersal is a product of Condea, and is an alumina. Ludox SM is a product of Du Pont, and is a silica.

We claim:

1. A method for rinsing dishes in a machine dishwasher comprising applying to said dishes an aqueous rinse liquor to which has been added a composition comprising an inorganic non-plate-shaped colloid in an aqueous medium, said colloid being present in an effective amount to minimize spot formation and drying time.

2. A method according to claim 1 wherein said colloid is present in an amount from 0.2 to 25% by weight of the composition.

3. A method according to claim 1 wherein the composition further comprises from 10 to 30% by weight of the composition of a $C_1$–$C_3$ alcohol.

4. A method according to claim 1 wherein said non-plate-shaped colloid is selected from the group consisting of silica, alumina and titania.

5. A method according to claim 1 wherein the colloid is present in said composition as a two-dimensional array of particles.

6. A method according to claim 1 wherein the composition further comprises a material selected from the group consisting of citric acid, hydrotropes, wetting agents and mixtures thereof.

* * * * *